US009083086B2

(12) United States Patent
Chan et al.

(10) Patent No.: US 9,083,086 B2
(45) Date of Patent: Jul. 14, 2015

(54) HIGH GAIN AND WIDEBAND COMPLEMENTARY ANTENNA

(75) Inventors: Chi Hou Chan, Hong Kong (HK); Hang Wong, Hong Kong (HK); Hau Wah Lai, Hong Kong (HK); Kwok Kan So, Hong Kong (HK); Kwai Man Luk, Hong Kong (HK); Quan Xue, Hong Kong (HK)

(73) Assignee: CITY UNIVERSITY OF HONG KONG, Hong Kong (HK)

( * ) Notice: Subject to any disclaimer, the term of this patent is extended or adjusted under 35 U.S.C. 154(b) by 353 days.

(21) Appl. No.: 13/611,949

(22) Filed: Sep. 12, 2012

(65) Prior Publication Data

US 2014/0071006 A1 Mar. 13, 2014

(51) Int. Cl.

| | |
|---|---|
| ***H01Q 1/00*** | (2006.01) |
| ***H01Q 21/26*** | (2006.01) |
| ***H01Q 9/04*** | (2006.01) |
| ***H01Q 9/16*** | (2006.01) |
| ***H01Q 21/28*** | (2006.01) |

(52) U.S. Cl.

CPC ..... *H01Q 21/26* (2013.01); *H01Q 9/0407* (2013.01); *H01Q 9/16* (2013.01); *H01Q 21/28* (2013.01)

(58) Field of Classification Search

USPC ..... 343/700 MS, 795, 846, 725, 730, 821

See application file for complete search history.

(56) References Cited

U.S. PATENT DOCUMENTS

| | | | | |
|---|---|---|---|---|
| 3,594,806 | A | 7/1971 | Black et al. | |
| 4,724,443 | A | 2/1988 | Nysen | |
| 6,317,084 | B1 | 11/2001 | Chen et al. | |
| 6,593,887 | B2 | 7/2003 | Luk et al. | |
| 7,119,746 | B2 | 10/2006 | Luk et al. | |
| 7,236,130 | B2 * | 6/2007 | Voigtlaender | 343/700 MS |
| 7,843,389 | B2 * | 11/2010 | Luk et al. | 343/700 MS |
| 7,999,744 | B2 | 8/2011 | Chin et al. | |
| 2005/0237260 | A1 * | 10/2005 | Bancroft | 343/859 |
| 2011/0006960 | A1 * | 1/2011 | Edwards et al. | 343/730 |

FOREIGN PATENT DOCUMENTS

| | | | |
|---|---|---|---|
| CN | 100428564 | C | 12/2005 |

* cited by examiner

*Primary Examiner* — Tan Ho

(74) *Attorney, Agent, or Firm* — Ware Fressola Maguire & Barber LLP

(57) ABSTRACT

An antenna is disclosed as including at least one dipole connected with at least one shorted patch antenna, and at least two feeding sources.

24 Claims, 11 Drawing Sheets

Fig. 2A
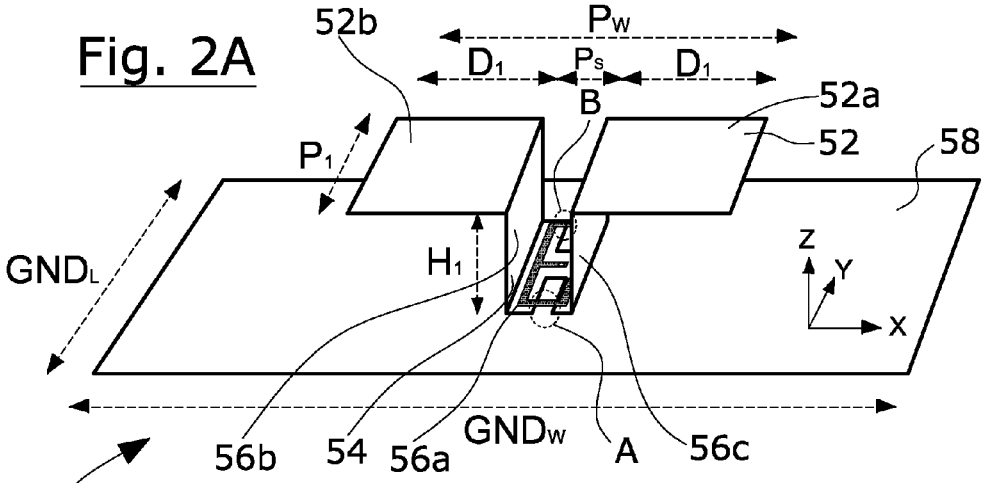
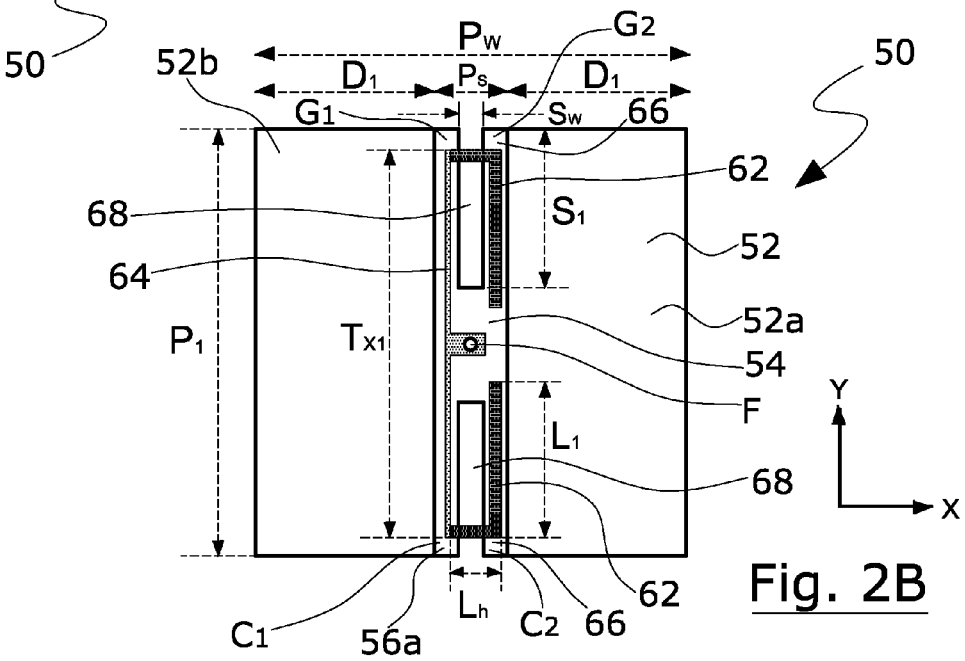
Fig. 2B
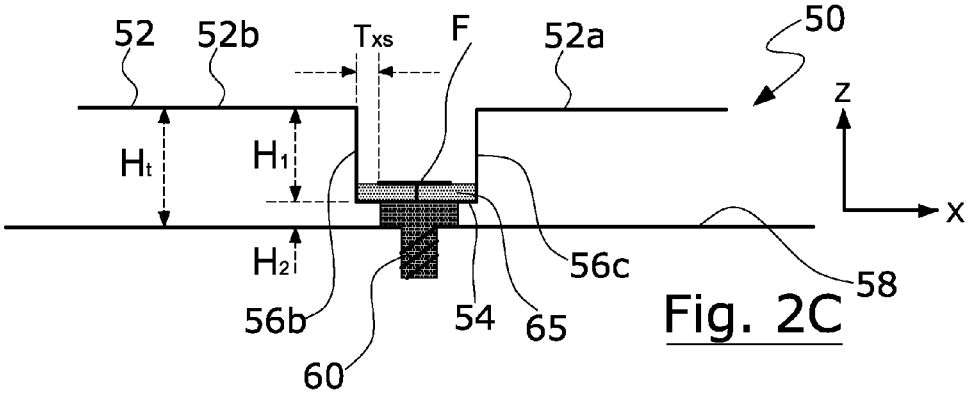
Fig. 2C 3.5GHz

4GHz $E_\theta$ at Ø = 0°
$E_\phi$ at Ø = 0°
$E_\phi$ at Ø = 90°
$E_\theta$ at Ø = 90°

$E_\theta$ at Ø = 0°

$E_\phi$ at Ø = 0°

$E_\phi$ at Ø = 90°

$E_\theta$ at Ø = 90°

HIGH GAIN AND WIDEBAND COMPLEMENTARY ANTENNA

TECHNICAL FIELD

This invention relates to an antenna, in particular an antenna suitable for, but not limited to, transmitting and receiving radio frequency signals. Such an antenna may also be used as an antenna element for constructing antenna arrays.

BACKGROUND OF THE INVENTION

There are normally two points of emphasis in the design of base station antennae for modern wireless communications, namely the operating bandwidth and the gain. Base station antennae with wider bandwidth can cover more frequency channels, increase the channel capacity, and enhance manufacturing tolerances. On the other hand, constructing antenna arrays is the simplest and an effective way to increase the gain. If the gain of the array element increases by 3 dB, for the same overall gain, the total number of array elements can be reduced by half, thus reducing the array antenna size. Therefore, it is important to provide an antenna element with wideband and high gain characteristics. There are several known techniques for enhancing bandwidth and gain. However, most of such techniques cannot be used at the same time. In addition, even if the antenna element is wideband and high gain at the same time, the structure is usually very complicated or bulky.

It is thus an object of the present invention to provide an antenna and an antenna array in which the aforesaid shortcomings are mitigated or at least to provide a useful alternative to the trade and public.

SUMMARY OF THE INVENTION

According to a first aspect of the present invention, there is provided an antenna including at least one dipole connected with at least one shorted patch antenna, and at least two feeding sources.

According to a second aspect of the present invention, there is provided an antenna array formed of a plurality of antennae, at least one of said antennae including at least one dipole connected with at least one shorted patch antenna, and at least two feeding sources.

BRIEF DESCRIPTION OF THE DRAWINGS

Embodiments of the present invention will now be described, by way of examples only, with reference to the accompanying drawings, in which:

FIG. 2A is a perspective view of an antenna according to an embodiment of the present invention, being in wideband mode;

FIG. 2B is a top view of the antenna of FIG. 2A;

FIG. 2C is a front view of the antenna of FIG. 2A;

DETAILED DESCRIPTION OF THE EMBODIMENTS

Figure 1A:
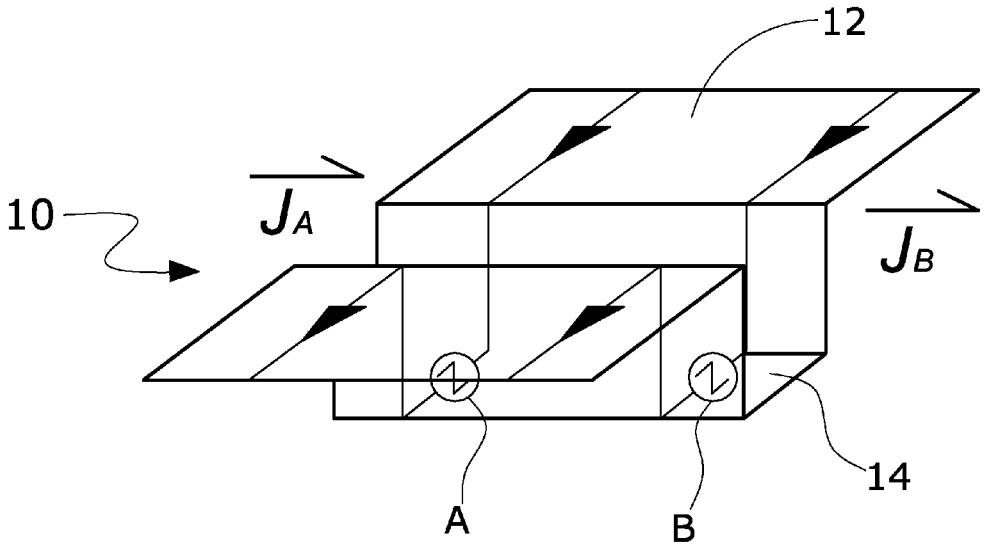
FIG. 1A is a schematic diagram showing the current direction of the electric dipole of an antenna according to the present invention.
Figure 1B:
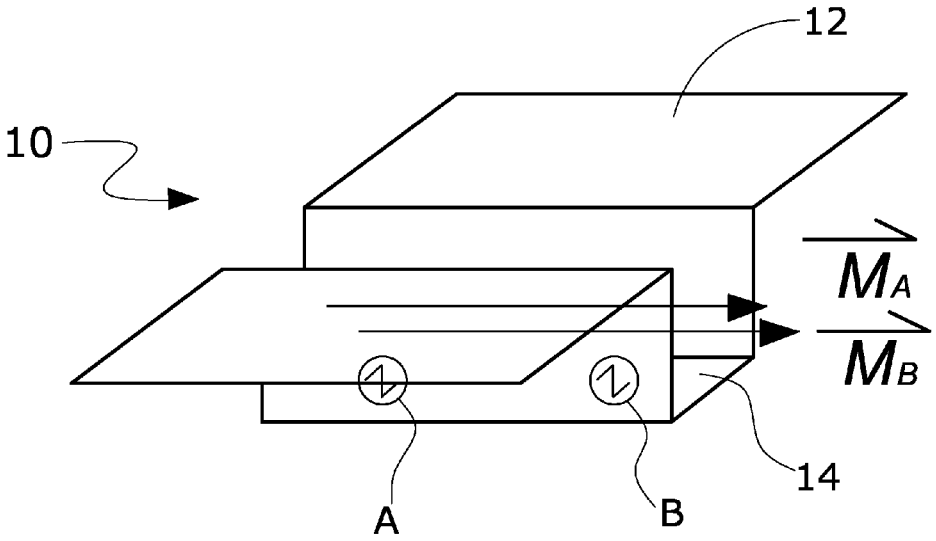
FIG. 1B is a schematic diagram showing the current direction of the magnetic dipole of the antenna schematically shown in FIG. 1A.

The basic principle of construction of an antenna according to an embodiment of the present invention is shown schematically in FIGS. 1A and 1B. More particularly, FIGS. 1A and 1B show a dual fed complementary antenna, generally designated as 10, with a planar dipole 12 and a patch antenna 14 shorted in electrical sense. Such a combination results in a wideband antenna which is excellent in all electrical characteristics, including low back radiation, low cross polarization, symmetrical radiation pattern, high in gain and stable radiation pattern over the frequency bandwidth.

In this embodiment, the antenna 10 has two feeding sources, which are located at positions A and B marked by dotted lines in FIG. 2A, and are in phase with each other. Many balun devices can be used as the feeding source, such as coaxial balun, coupled line balun and Marchand balun.

As shown in FIGS. 1A and 1B, each feeding source generates one electric dipole ($\vec{J}_A$ or $\vec{J}_B$) and one magnetic dipole ($\vec{M}_A$ or $\vec{M}_B$). The magnitudes of the two feeding sources are the same ($\vec{J}_A=\vec{J}_B=\vec{J}$ and $\vec{M}_A=\vec{M}_B=\vec{M}$). As there are two excitation sources in the antenna 10, two electric and two magnetic dipoles are effectively generated. Their radiation ($2\vec{J}+2\vec{M}$) will be doubled and a gain of 3 dB higher than the conventional magneto-electric dipole antenna is achieved.

FIGS. 2A to 2C show various views of an antenna according to an embodiment of the present invention, generally designated as 50. The antenna 50 is formed by connecting a rectangular planar dipole 52 (with dipole patches 52*a*, 52*b* formed of metal plates) to the open end of a shorted patch antenna 54 (comprising a ground plane 56*a*, and a pair of metal plates 56*b*, 56*c* which are parallel to and spaced apart from each other), with a large metal plane 58 located below the patch antenna 54 for back lobe reduction. The dipole 52 is connected with the shorted patch antenna 54 via the two metal plates 56*b*, 56*c*. The ground plane 56*a* of the shorted patch antenna 54 is parallel to the dipole patches 52*a*, 52*b* and the large metal plane 58, and is perpendicular to the pair of metal plates 56*b*, 56*c*.

The ground plane 56*a* of the shorted patch antenna 54 is H-shaped and is either electrically or physically connected to the large metal plane 58. Depending on the type of connection between the ground plane 56*a* of the shorted patch antenna 54 and the ground plane 56*a*, the large metal plane 58 may be a ground plane or a reflector. If the large metal plane 58 and the ground plane 56*a* of the shorted patch antenna 54 are electrically connected with each other, the large metal plane 58 is a ground plane. If, on the other hand, the large metal plane 58 and the ground plane 56*a* of the shorted patch antenna 54 are connected physically but not electrically, the large metal plane 58 is a reflector. The H-shaped ground plane 56*a* is spaced apart from and above the large metal plane 58 by a distance of $H_2$. A SubMiniature version A (SMA) connector 60 is used for supporting and providing an electrical connection between the H-shaped ground plane 56*a* and the large metal plane 58.

In this embodiment, each side of the dipole 52 has a width $P_1$ and a length $D_1$. $D_1$ is about $0.25\lambda_0$, where $\lambda_0$ is the free-space wavelength of the center frequency of the antenna 50. The shorted patch antenna 54 has a height of $H_t$, which is around $0.18\lambda_0$. For wideband operation, the separation $P_S$ of the two plates 56*b*, 56*c* of the shorted patch antenna 54 is close to $0.1\lambda_0$, while the width $P_1$ of the dipole 52 and of the shorted patch antenna 54 should be around $0.64\lambda_0$. For a given backlobe of less than −20 dBi (or front-to-back ratio of more than 20 dB), the size of the large metal plane 58 can be adjusted and is preferably around $1\lambda_0$ by $1\lambda_0$.

The antenna 50 has two sources and they are located at position A and position B in FIG. 2A. In this antenna 50, the Marchand balun is used as the feeding source. The feeding mechanism is made up of three portions, namely a pair of L-strips 62, a T-junction microstrip line 64, and the H-shaped ground plane 56*a*. All these three portions are made of metallic and/or conducting material. The two L-strips 62 are electrically connected to the T-junction microstrip line 64, and they are both located above the H-shaped ground plane 56*a*. The two L-strips 62 and T-junction microstrip line 64 (which combine to form a feeding network) and the H-shaped ground plane 56*a* are separated by a substrate 65, such as air or some other dielectric material.

The ground plane 56*a* has a pair of elongate plates 66 which are joined with each other at their middle portion and spaced apart from each other by a slot 68 at each of the longitudinal ends of the elongate plates 66. Each L-strip 62 has a portion overlapping with the slot 68 on the H-shaped ground plane 56*a*, and each of these combinations forms a feeding source. The feeding position of the antenna 50 is located at point F. Each source is a balun source which can provide a precise 180° phase shift across the width of the H-shaped slot 68 at $C_1$ and $C_2$ (or $G_1$ and $G_2$) in FIG. 2B, with minimum loss and equal balanced impedances.

The shape of the feeding network, which is the combination of the two L-strips 62 and the T-junction microstrip line 64, is a pair of mirrored Γ-shaped strips. The impedance of the antenna 50 is typically 50Ω. The T-junction microstrip line 64 is therefore designed with the input port in 50Ω and two output ports in 100Ω. The length of the two L-strips 62 in x- and y-directions can provide inductive and capacitive impedances to the antenna 50, and they are optimized to 100Ω.

Tables 1A and 1B below show exemplary dimensions (in mm and in terms of $\lambda_0$) of the parameters of the antenna 50 shown in FIGS. 2A to 2C:

TABLE 1A

| Parameters | $P_w$ | $P_1$ | $D_1$ | $P_s$ | $H_t$ | $H_1$ | $H_2$ |
|---|---|---|---|---|---|---|---|
| Values | 60 mm | 60 mm | 25.5 mm | 9 mm | 17 mm | 15.5 mm | 1.5 mm |
| | $0.64\lambda_0$ | $0.64\lambda_0$ | $0.272\lambda_0$ | $0.1\lambda_0$ | $0.18\lambda_0$ | $0.165\lambda_0$ | $0.016\lambda_0$ |

TABLE 1B

| Parameters | $S_w$ | $S_1$ | $L_h$ | $L_1$ | $T_{x1}$ | $T_{xs}$ |
|---|---|---|---|---|---|---|
| Values | 3 mm | 22 mm | 6.24 mm | 19.6 mm | 54.8 mm | 1.625 mm |
| | $0.032\lambda_0$ | $0.235\lambda_0$ | $0.067\lambda_0$ | $0.209\lambda_0$ | $0.585\lambda_0$ | $0.173\lambda_0$ |

Figure 3:
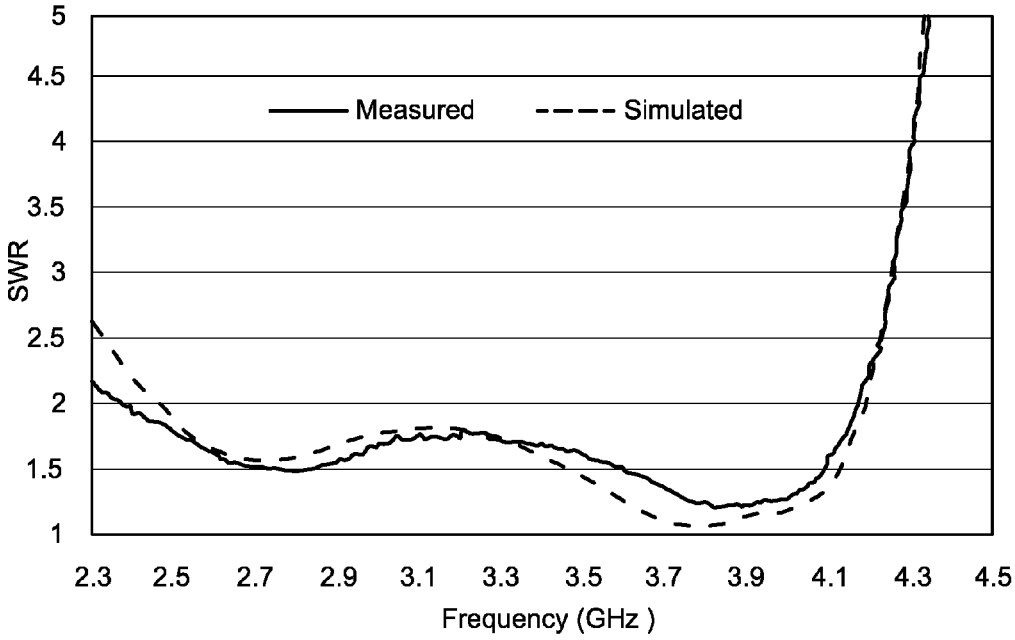
FIG. 3 shows measured and simulated standing wave ratios (SWR) against frequency of the antenna of FIG. 2A.
Figure 4:
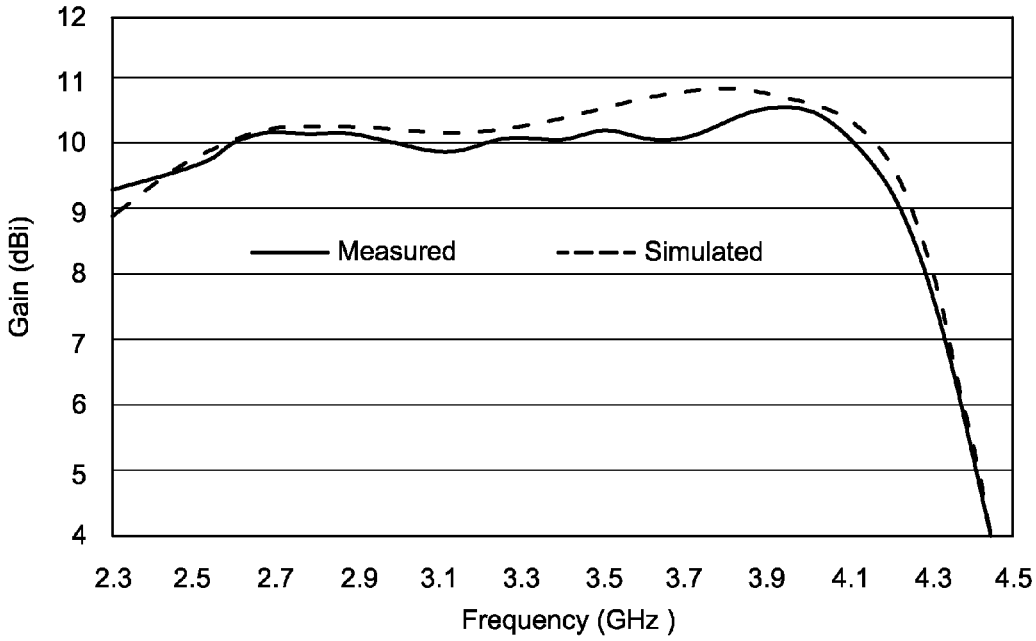
FIG. 4 shows measured and simulated gain against frequency of the antenna of FIG. 2A.
Figure 5A:
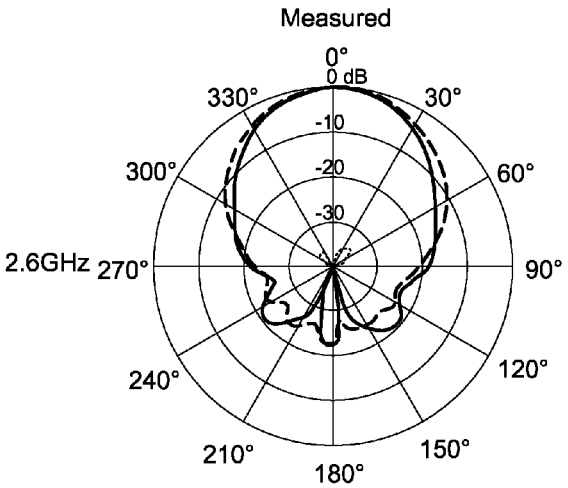
FIGS. 5A to 5H show measured and simulated radiation patterns of the antenna of FIG. 2A.
Figure 5B:
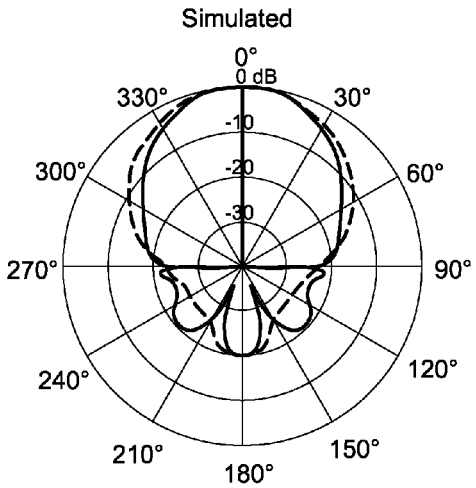
Figure 5C:
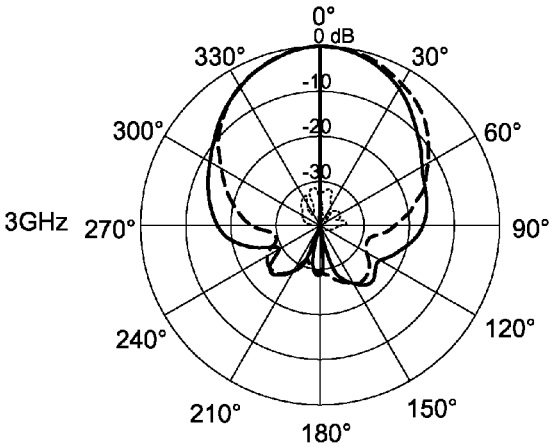
Figure 5D:
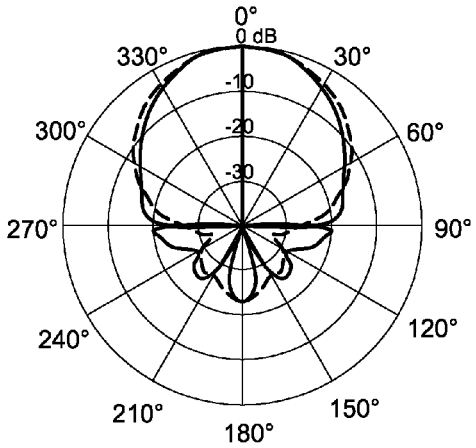
Figure 5E:
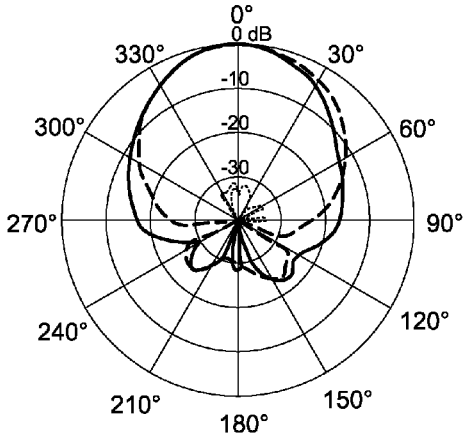
Figure 5F:
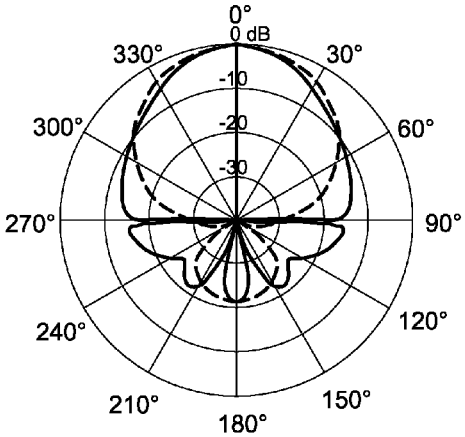
Figure 5G:
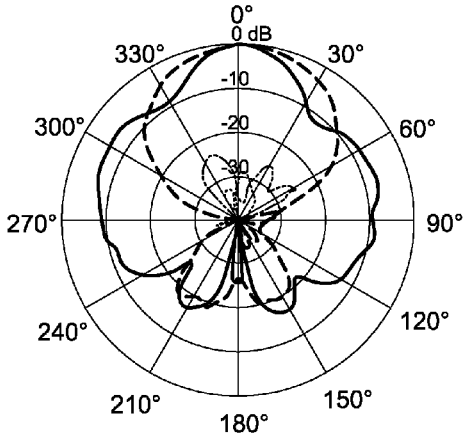
Figure 5H:
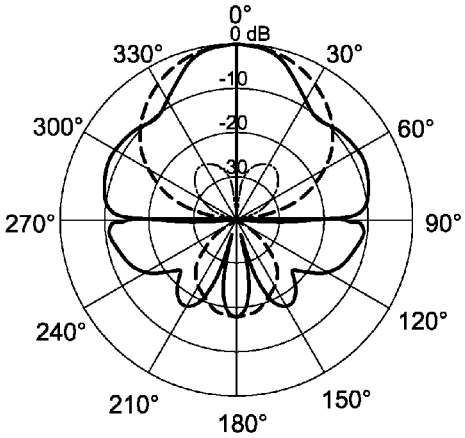

The measured and simulated standing wave ratios (SWR) of a design of the antenna 50 are shown in FIG. 3. It can be seen that the antenna 50 has a wide measured impedance bandwidth of 55% (with SWR less than 2 from 2.37 GHz to 4.18 GHz). FIG. 4 shows that the antenna 50 has an average gain of 10 dBi, varying from 9.5 dBi to 11 dBi, which is only a slight variation.

The measured and simulated radiation patterns and half power beamwidths of the antenna 50 at frequencies of 2.6, 3, 3.5 and 4 GHz are shown in FIGS. 5A to 5H and Table 2 below:

TABLE 2

| | Half power beamwidth | | | |
|---|---|---|---|---|
| | Measured | | Simulated | |
| Plane | 0° | 90° | 0° | 90° |
| 2.6 GHz | 48.9° | 55.7° | 48.8° | 59° |
| 3.0 GHz | 53.3° | 51.9° | 48.4° | 56° |
| 3.5 GHz | 48.7° | 52° | 43.5° | 54° |
| 4.0 GHz | 28.5° | 51.4° | 33° | 51.8° |

In both E and H planes, the broadside radiation patterns are stable and symmetrical. At 3 GHz, the half power beamwidth at $\phi=0°$ plane (E-plane) is 53.3° which is slightly higher than the half power beamwidth at $\phi=90°$ plane (H-plane), which is 52°. Also, low cross polarization and low back radiation are observed across the entire operating bandwidth.

The antenna 50 can be optimized to have higher gain, with a tradeoff in bandwidth reduction. While the antenna 50 of the configuration discussed in the previous section is the wideband mode, the antenna in the configuration shown in FIG. 6, generally designated as 100, is the high gain mode.

The geometry of the antenna 100 in high gain mode is similar to that of the antenna 50 in wideband mode. A first modification is to reduce the height of the antenna 100 from $0.18\lambda_0$ to $0.12\lambda_0$. Another modification is the introduction of a pair of stubs extended from the side of the feeding position, namely point F'.

Figure 6A:
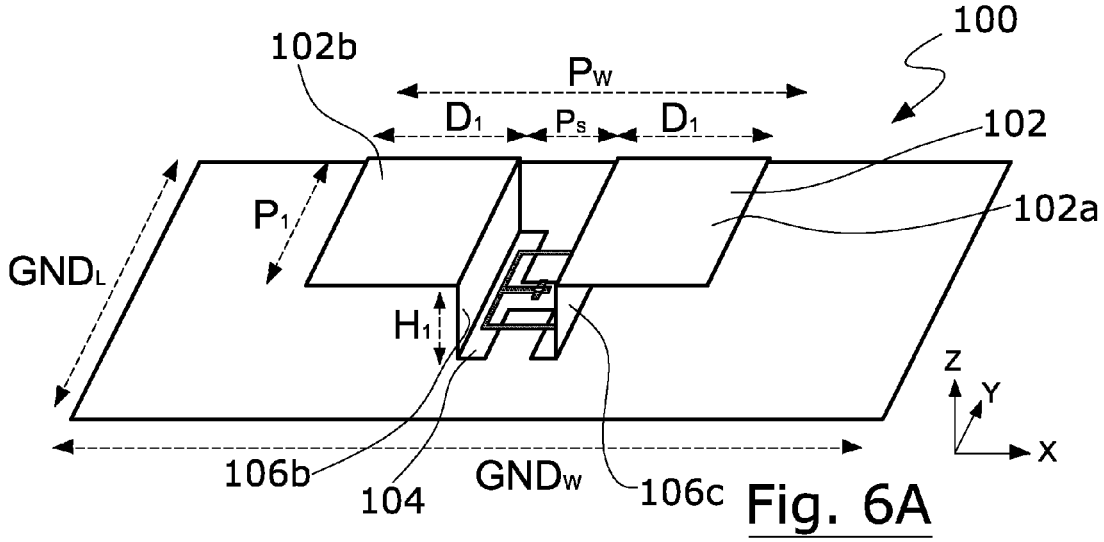
FIG. 6A is a perspective view of an antenna according to a further embodiment of the present invention, being in high gain mode.
Figure 6B:
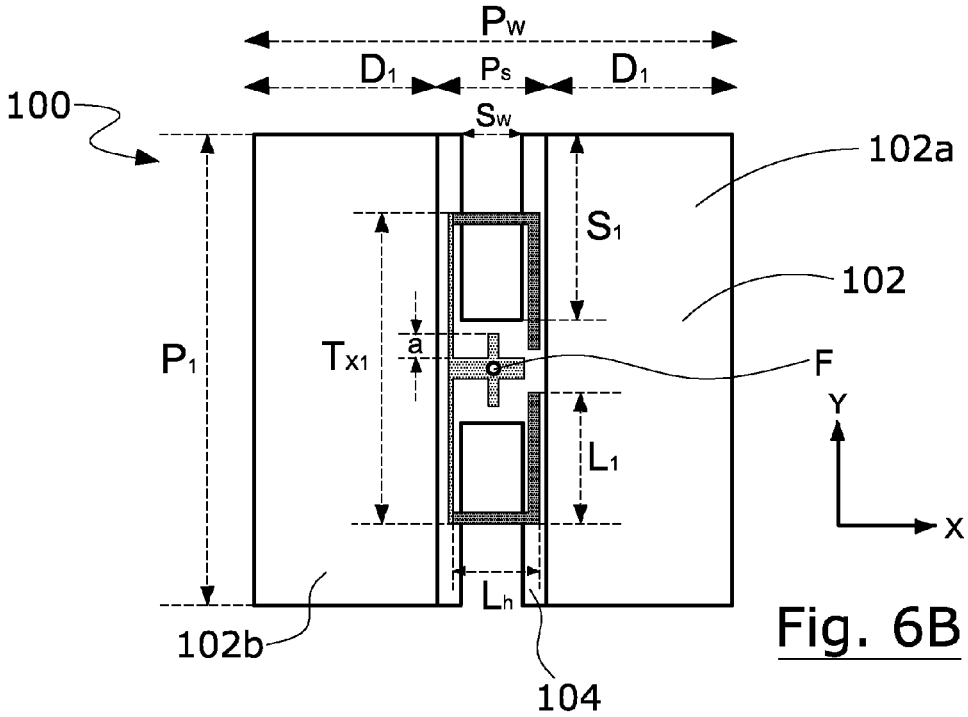
FIG. 6B is a top view of the antenna of FIG. 6A.
Figure 6C:
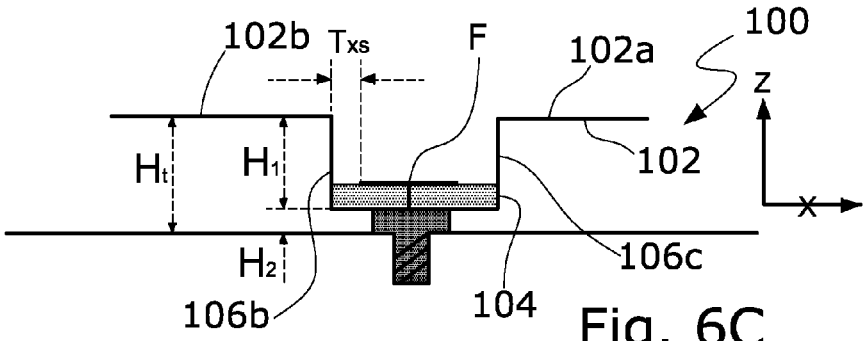
FIG. 6C is a front view of the antenna of FIG. 6A.

Tables 3A and 3B below show exemplary dimensions (in mm and in terms of $\lambda_0$) of the parameters of the antenna 100 shown in FIGS. 6A to 6C:

TABLE 3A

| Parameters | $P_w$ | $P_1$ | $D_1$ | $P_s$ | $H_t$ | $H_1$ | $H_2$ |
|---|---|---|---|---|---|---|---|
| Values | 60 mm<br>$0.7\lambda_0$ | 60 mm<br>$0.7\lambda_0$ | 23 mm<br>$0.268\lambda_0$ | 14 mm<br>$0.163\lambda_0$ | 10.3 mm<br>$0.12\lambda_0$ | 8.8 mm<br>$0.103\lambda_0$ | 1.5 mm<br>$0.018\lambda_0$ |

TABLE 3B

| Parameters | $S_w$ | $S_1$ | $L_h$ | $L_1$ | $T_{x1}$ | $T_{xs}$ | a |
|---|---|---|---|---|---|---|---|
| Values | 7 mm<br>$0.082\lambda_0$ | 23.5 mm<br>$0.274\lambda_0$ | 10.8 mm<br>$0.126\lambda_0$ | 16.7 mm<br>$0.195\lambda_0$ | 38.6 mm<br>$0.451\lambda_0$ | 1.125 mm<br>$0.013\lambda_0$ | 3 mm<br>$0.035\lambda_0$ |

Figure 7:
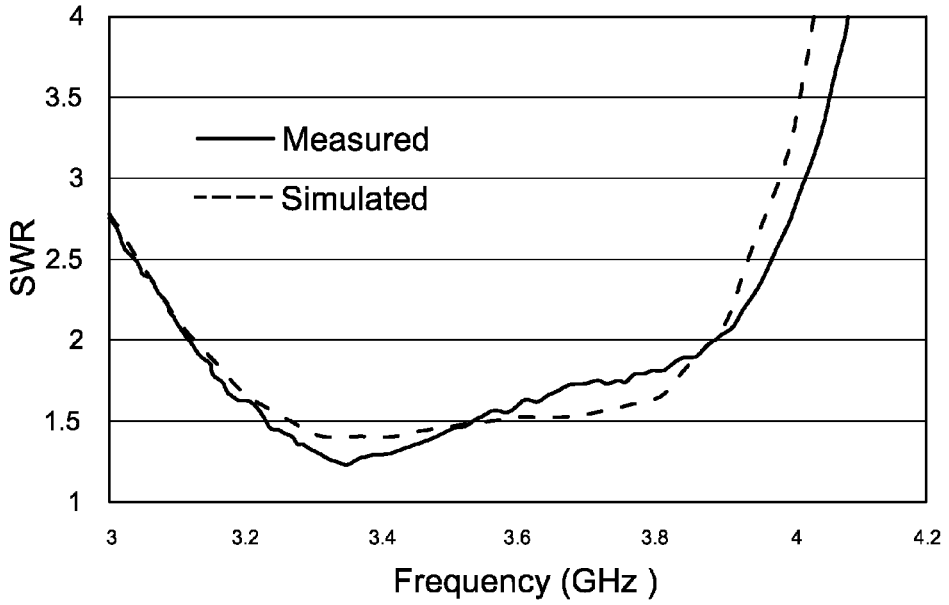
FIG. 7 shows measured and simulated SWR against frequency of the antenna of FIG. 6A.

The measured and simulated standing wave ratios (SWR) of a typical high gain mode antenna 100 according to the present invention are shown in FIG. 7. It can be seen that the antenna 100 has a wide measured impedance bandwidth of 22% (with SWR less than 2 from 3.115 GHz to 3.89 GHz).

Figure 8:
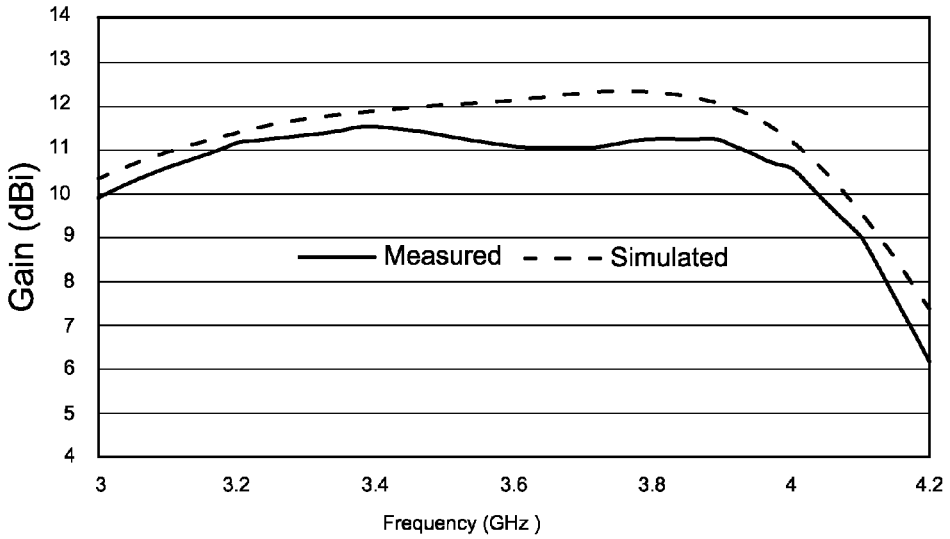
FIG. 8 shows measured and simulated gain against frequency of the antenna of FIG. 6A.
Figure 9A:
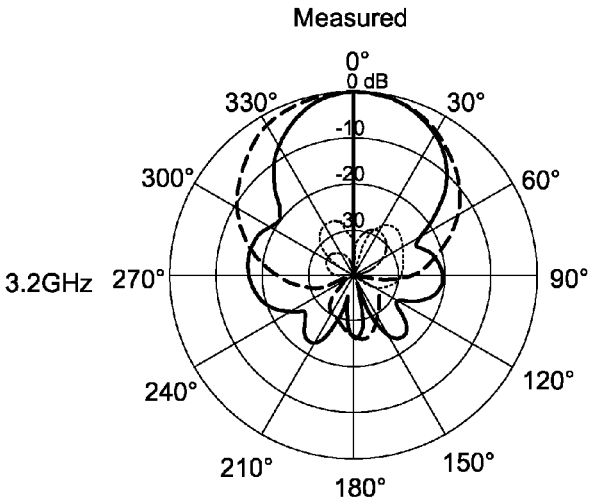
FIGS. 9A to 9F show measured and simulated radiation patterns of the antenna of FIG. 6A.
Figure 9B:
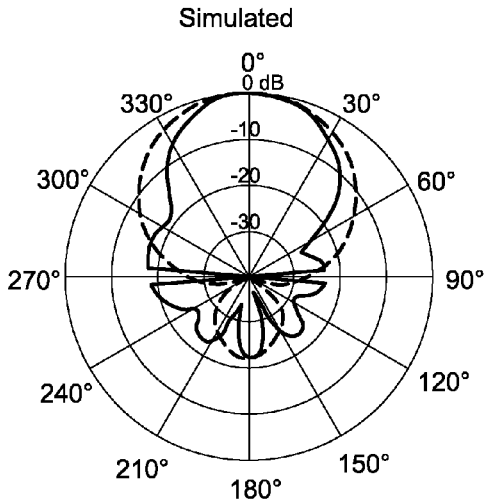
Figure 9C:
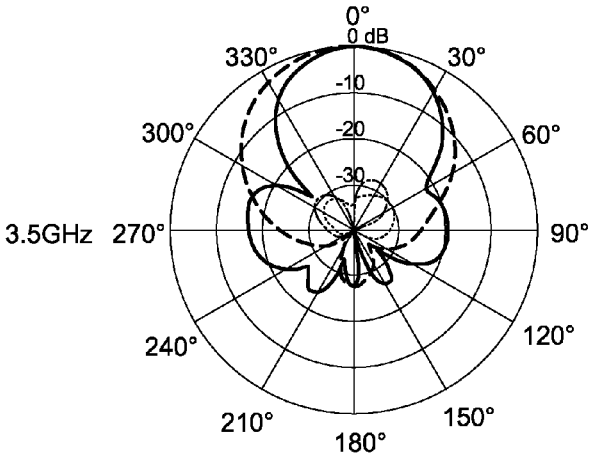
Figure 9D:
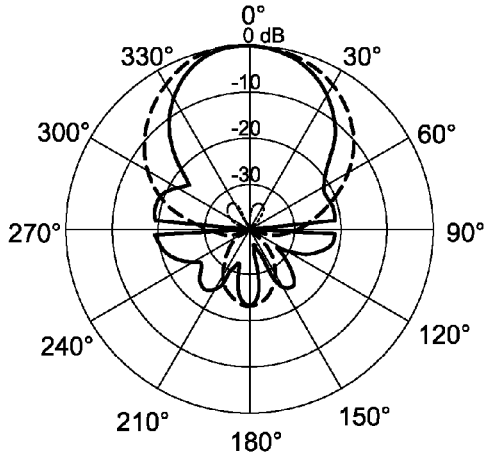
Figure 9E:
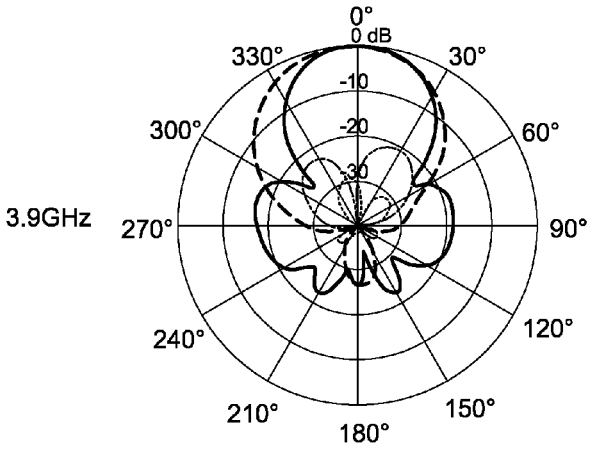
Figure 9F:
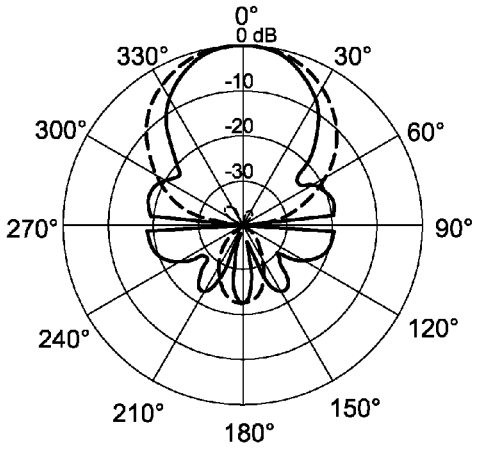

FIG. 8 shows that the antenna 100 has an average measured gain of 11 dBi. The gain varies from 10.8 dBi to 11.5 dBi within the operating bandwidth. The variation is very small, which is only 0.7 dB, and is better than half the variation of 1.5 dB in the wideband mode antenna 50 discussed above.

The measured and simulated radiation patterns and half power beamwidths of the antenna 100 at frequencies of 3.2, 3.5 and 3.9 GHz are shown in FIG. 9 and Table 4 below:

TABLE 4

| | Half power beamwidth | | | |
|---|---|---|---|---|
| | Measured | | Simulated | |
| Plane | 0° | 90° | 0° | 90° |
| 3.2 GHz | 42.9° | 56.3° | 42° | 55° |
| 3.5 GHz | 42° | 51.9° | 40° | 52.5° |
| 3.9 GHz | 37.1° | 48.6° | 37° | 48.8° |

In both E and H planes, the broadside radiation patterns are stable and symmetrical. At 3.5 GHz, the half power beamwidth at $\phi=0°$ plane (E-plane) is 42°, which is narrower than the half power beamwidth of 52° at $\phi=90°$ plane (H-plane). The antenna 100 also has low cross polarization and low back radiation across the entire operating bandwidth.

For further reduction of the antenna height, dielectric materials can be loaded below the dipole patches 52*a*, 52*b* of the dipole 52 and/or in the portion between the two vertical walls 56*b*, 56*c* of the shorted patch 54 of the antenna 50. Dielectric materials can also be loaded below dipole patches 102*a*, 102*b* of a dipole 102 and/or in the portion between two vertical walls 106*b*, 106*c* of a shorted patch antenna 104 of the antenna 100 to achieve the same effect.

Figure 10A:
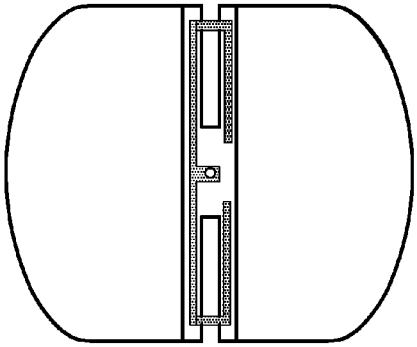
FIGS. 10A and 10B show antennae according to further embodiments of the present invention, with planar dipoles of different shapes.
Figure 10B:
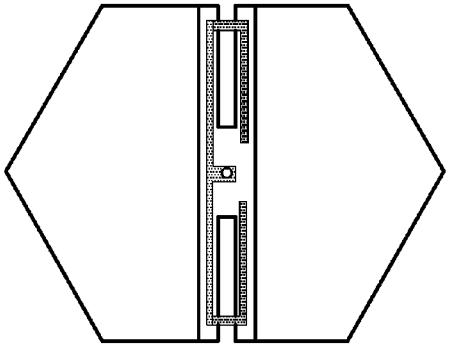
Figure 11A:
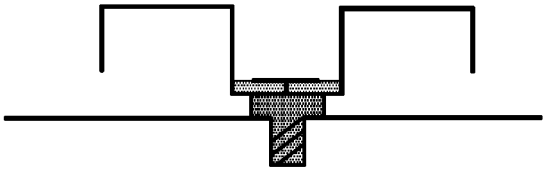
FIGS. 11A and 11B show folded antennae according to additional embodiments of the present invention.
Figure 11B:
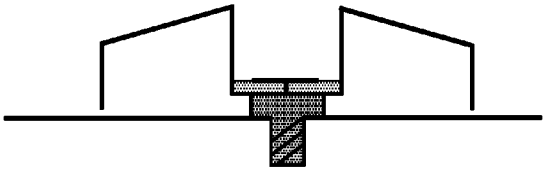

The planar dipole 12, 52, 102 can have different shapes, such as with rounded corners or polygonal in shape, as shown in FIGS. 10A and 10B. For size reduction, the dipole 12, 52, 102 can be instead folded in different ways, as shown in FIGS. 11A and 11B.

Figure 12A:
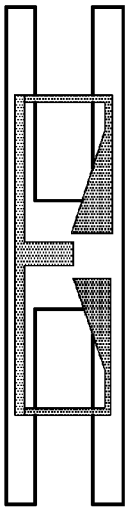
FIGS. 12A to 12C show feeding probes of various shapes which may be adopted in antennae according to the present invention.
Figure 12B:
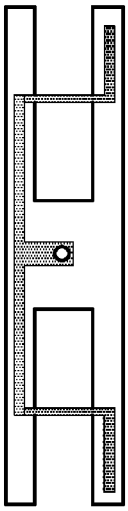
Figure 12C:
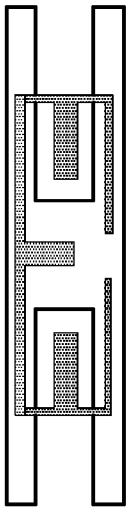

Similar performance can be obtained if the L-strips 62 are replaced by metal strips of other shapes, such as polygonal, folded outwardly, or F-shaped, as shown in FIGS. 12A, 12B and 12C respectively.

Figure 13A:
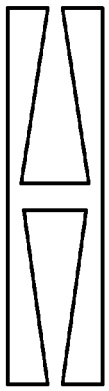
FIGS. 13A to 13C show ground planes of various shapes which may be adopted in antennae according to the present invention.
Figure 13B:
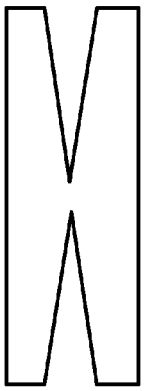
Figure 13C:
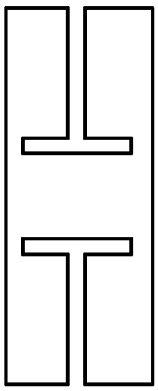

The antenna 10, 50, 100 can also function if the H-shaped ground plane 56*a* is replaced by ground planes of other geometries. As shown in FIGS. 13A to 13C, the elongate plates 66 of the ground plane 56*a* may be polygonal, triangular in shape or T-shaped.

Figure 14A:
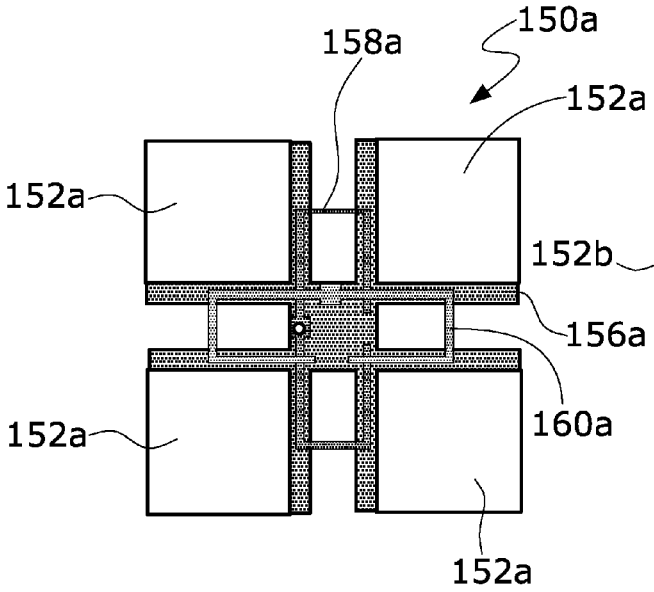
FIGS. 14A and 14B show configurations of dual polarization antennae according to yet further embodiments of the present invention.
Figure 14B:
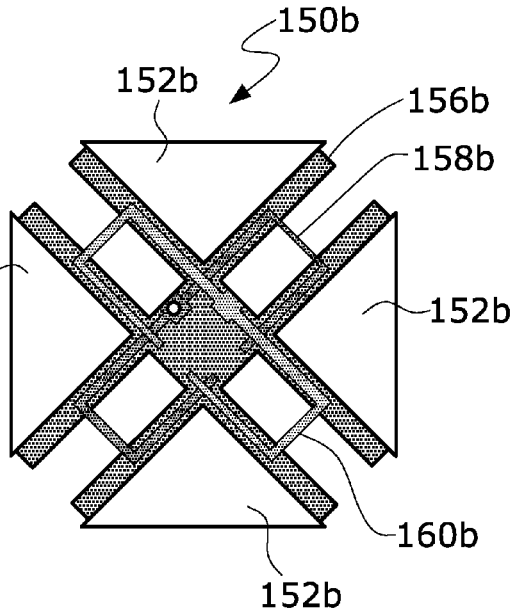

The antenna 10, 50, 100 can be extended to dual-polarization antenna. FIGS. 14A and 14B show two possible antennae 150*a*, 150*b* of different configurations. In both configurations, the H-shaped ground plane is replaced by a cross-shaped ground plane 156*a*, 156*b* respectively, with some slots cutting on it. A respective feeding line 158*a*, 158*b* is placed above the cross-shaped ground plane 156*a*, 156*b*; while another feeding line 160*a*, 160*b* for the other polarization is located below the cross-shaped ground plane 156*a*, 156*b*. In both configurations 150*a*, 150*b*, dipole patches 152*a*, 152*b* are located at the four corners of the respective antenna 150*a*, 150*b*.

It is possible to construct an antenna array with a number of antennae, including at least one antenna 10, 50, 100, 150*a*, 150*b* according to the present invention.

2G, 3G, LTE, Wi-Fi and WiMAX demand high gain and wideband unidirectional antennae with low cross-polarization, low back radiation, symmetric radiation pattern and stable gain over the operating frequency range. As an antenna according to the present invention functions as a high gain complementary wideband antenna element, such could fulfill the above requirements, and is thus suitable for modern wireless communication systems. In particular, because of its wideband characteristic, an antenna according to the present invention can cover all 2G, 3G and 4G applications. In addition, its wideband characteristic allows better manufacturing tolerances, which translates into lower tuning cost. At the same time, because of its high gain, an antenna according to the present invention can save cost, space, and energy and is good candidate for green communications.

A high gain complementary wideband antenna according to the present invention has excellent mechanical and electrical characteristics, including low profile, wide impedance bandwidth, high gain and stable radiation pattern. Higher gain translates into fewer elements in the array formed of antennae according to the present invention, thus reducing antenna size and cost. The fact that such an antenna is of low profile would allow for better integration with other active and passive components in the array. A base station antenna constructed on the basis of antennae according to the present invention could provide excellent array performance.

It should be understood that the above only illustrates examples whereby the present invention may be carried out, and that various modifications and/or alterations may be made thereto without departing from the spirit of the invention.

It should also be understood that certain features of the invention, which are, for clarity, described in the context of separate embodiments, may be provided in combination in a single embodiment. Conversely, various features of the invention which are, for brevity, described in the context of a single embodiment, may also be provided separately or in any appropriate sub-combinations.

The invention claimed is:

1. An antenna including at least one dipole connected with at least one shorted patch antenna, and at least two feeding sources, said at least one shorted patch antenna having a ground plane, a metal ground plane electrically connected to the at least one shorted patch antenna, said ground plane of said at least one shorted patch antenna being located in a position spaced apart from said metal ground plane.

2. The antenna according to claim 1 wherein said feeding sources are balun sources.

3. The antenna according to claim 2 wherein said balun sources are in phase with each other.

4. The antenna according to claim 2 wherein each said balun source is adapted, in operation, to generate one electric dipole and one magnetic dipole.

5. The antenna according to claim 1 wherein said at least two feeding sources are of identical magnitudes.

6. The antenna according to claim 1 wherein said at least one shorted patch antenna includes two metal plates.

7. The antenna according to claim 6 wherein said metal plates are substantially perpendicular to said ground plane.

8. The antenna according to claim 6 wherein said ground plane is substantially parallel to said at least one dipole.

9. The antenna according to claim 6 wherein said at least one dipole is connected with said at least one shorted patch antenna via said two metal plates.

10. An antenna array formed of a plurality of antennas, at least one of said antennas being an antenna according to claim 1.

11. An antenna including at least one dipole connected with at least one shorted patch antenna having a ground plane, and at least two feeding sources, wherein said at least one patch antenna is physically connected to a metal reflector plate, wherein said ground plane of said at least one shorted patch antenna is located in a position spaced apart from said metal reflector plate.

12. An antenna array formed of a plurality of antennas, at least one of said antennas being an antenna according to claim 11.

13. An antenna including at least one dipole connected with at least one shorted patch antenna having a ground plane, and at least two feeding sources, wherein said ground plane of said at least one shorted patch antenna has two elongate plates joined with each other at their substantially middle portion and spaced apart from each other by a slot at or adjacent each of their longitudinal ends.

14. The antenna according to claim 13 wherein said ground plane of said at least one shorted patch antenna is generally H-shaped.

15. The antenna according to claim 13 wherein each of said elongate plates is of a generally rectangular, triangular, polygonal or T shape.

16. An antenna array formed of a plurality of antennas, at least one of said antennas being an antenna according to claim 13.

17. An antenna including at least one dipole connected with at least one shorted patch antenna, and at least two feeding sources, wherein said at least one shorted patch antenna is electrically connected to a metal ground plane, and wherein each of said feeding sources includes a pair of L-shaped strips, a T-junction microstrip line and said metal ground plane of said at least one shorted patch antenna.

18. The antenna according to claim 17 wherein said pair of L-shaped strips are connected with said T-junction microstrip line.

19. The antenna according to claim 17 wherein said pair of L-shaped strips and said T-junction microstrip line are spaced apart from said metal ground plane of said at least one shorted patch antenna.

20. The antenna according to claim 17 wherein said T-junction microstrip line and said L-shaped strips are separated from said metal ground plane of said at least one shorted patch antenna by a layer of dielectric material.

21. The antenna according to claim 17 wherein a portion of each said L-shaped strip crosses one of said slots of said ground plane of said at least one shorted patch antenna.

22. An antenna array formed of a plurality of antennas, at least one of said antennas being an antenna according to claim 17.

23. An antenna including at least one dipole connected with at least one shorted patch antenna, and at least two feeding sources, wherein said antenna includes four dipole patches, a cross-shaped ground plane, one feeding line on said cross-shaped ground plane, and one feeding line below said cross-shaped ground plane.

24. An antenna array formed of a plurality of antennas, at least one of said antennas being an antenna according to claim 23.

* * * * *